US005497854A

United States Patent [19]

Fang

[11] Patent Number: 5,497,854

[45] Date of Patent: Mar. 12, 1996

[54] FALLPROOF SAFETY PARKING APPARATUS

[76] Inventor: I Liang Fang, No. 67, Huan Kung Road, Yung Kang Industrial Area, Yung Kang City, Tainan County, Taiwan

[21] Appl. No.: 300,203

[22] Filed: Sep. 2, 1994

[51] Int. Cl.[6] ..... B66F 7/00

[52] U.S. Cl. ..... 187/213; 187/209

[58] Field of Search ..... 187/213, 208, 187/209, 287, 364, 363; 254/89 R, 90, 2 B, 26

[56] References Cited

U.S. PATENT DOCUMENTS

| | | | |
|---|---|---|---|
| 2,843,223 | 7/1958 | Villars | 187/209 |
| 4,856,618 | 8/1989 | Isogai | 187/209 |

FOREIGN PATENT DOCUMENTS

| | | | |
|---|---|---|---|
| 1254225 | 1/1961 | France | 187/213 |

*Primary Examiner*—Kenneth Noland

*Attorney, Agent, or Firm*—Morton J. Rosenberg; David I. Klein

[57] ABSTRACT

A fallproof safety parking apparatus including a main body having a transverse beam and a lateral beam on which a detector and a detecting means are respectively disposed beside driving chains. The detector has a resilient pressing rod and the detecting means has a resilient pressing post for abutting against the chains without affecting the operation thereof. In case any section of the chains is broken apart, the resilient pressing rod of the detector or the resilient pressing post of the detecting means immediately bounds out from the broken section of the chains to actuate a microswitch of the detector or detecting means, making a fallproof means powered off. At this time, a brake block of the fallproof means is inserted into an insertion hole of a fixing lever of the main body and locked therein so as to instantaneously prevent an upper parking platform from straightly falling down. Two pairs of steel cables are disposed on the beams of the main body to help in holding the upper parking platform.

1 Claim, 6 Drawing Sheets

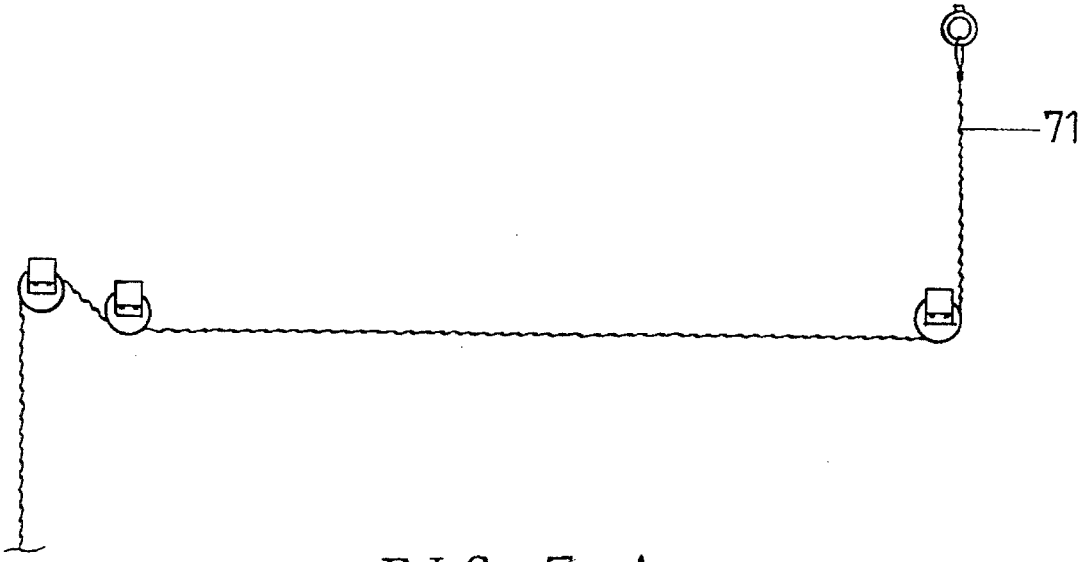
FIG. 7-A
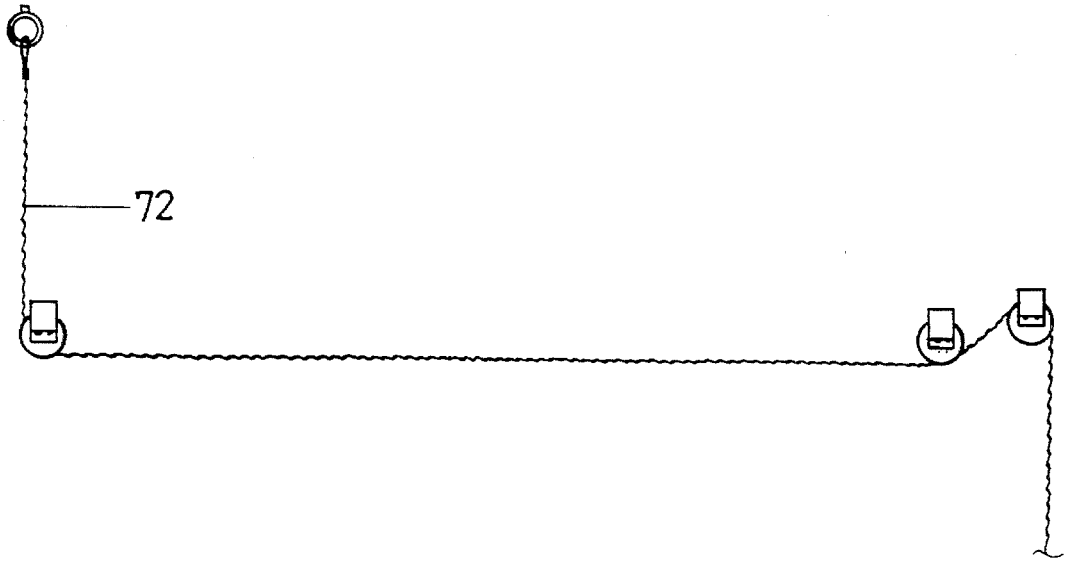
FIG. 7-B

FALLPROOF SAFETY PARKING APPARATUS

BACKGROUND OF THE INVENTION

The present invention relates to a fallproof safety parking apparatus.

An elevatory parking apparatus is widely used nowadays in order to more efficiently utilize the limited parking space. Such elevatory parking apparatus is generally driven by hydraulic cylinder through several chains. These chains tend to break apart due to over-load for a long period of use. This will result in serious injury of people and damage of the car parked on the parking apparatus.

Another type of conventional elevatory parking apparatus is driven by motor through chains. In such apparatus, hook members are disposed on two sides of a support frame of the apparatus and ring members are disposed on a parking platform corresponding to the hook members, whereby when the parking platform is lifted to an upper end of the support frame, the hook members hook the ring members to prevent the parking platform from falling down due to sudden breaking of the chains. However, such arrangement provides protective effect only for the car that has already been located at the top of the parking apparatus, while failing to lock and hold the car that tends to fall down due to breaking of the chains during the ascending or descending operation. Therefore, it is necessary to provide an improved elevatory parking apparatus which includes a fallproof means to ensures the safety.

SUMMARY OF THE INVENTION

It is therefore a primary object of the present invention to provide a fallproof safety parking apparatus which is able to instantaneously hold and lock the car that tends to fall down due to breaking of the chains during the ascending or descending operation. Therefore, the safety in parking is ensured.

BRIEF DESCRIPTION OF THE DRAWINGS

The present invention can be best understood through the following description and accompanying drawings, wherein:

FIGS. 7-1 and 7-2 show the arrangement of the steel cables; and

DETAILED DESCRIPTION OF THE PREFERRED EMBODIMENT

Figure 1:
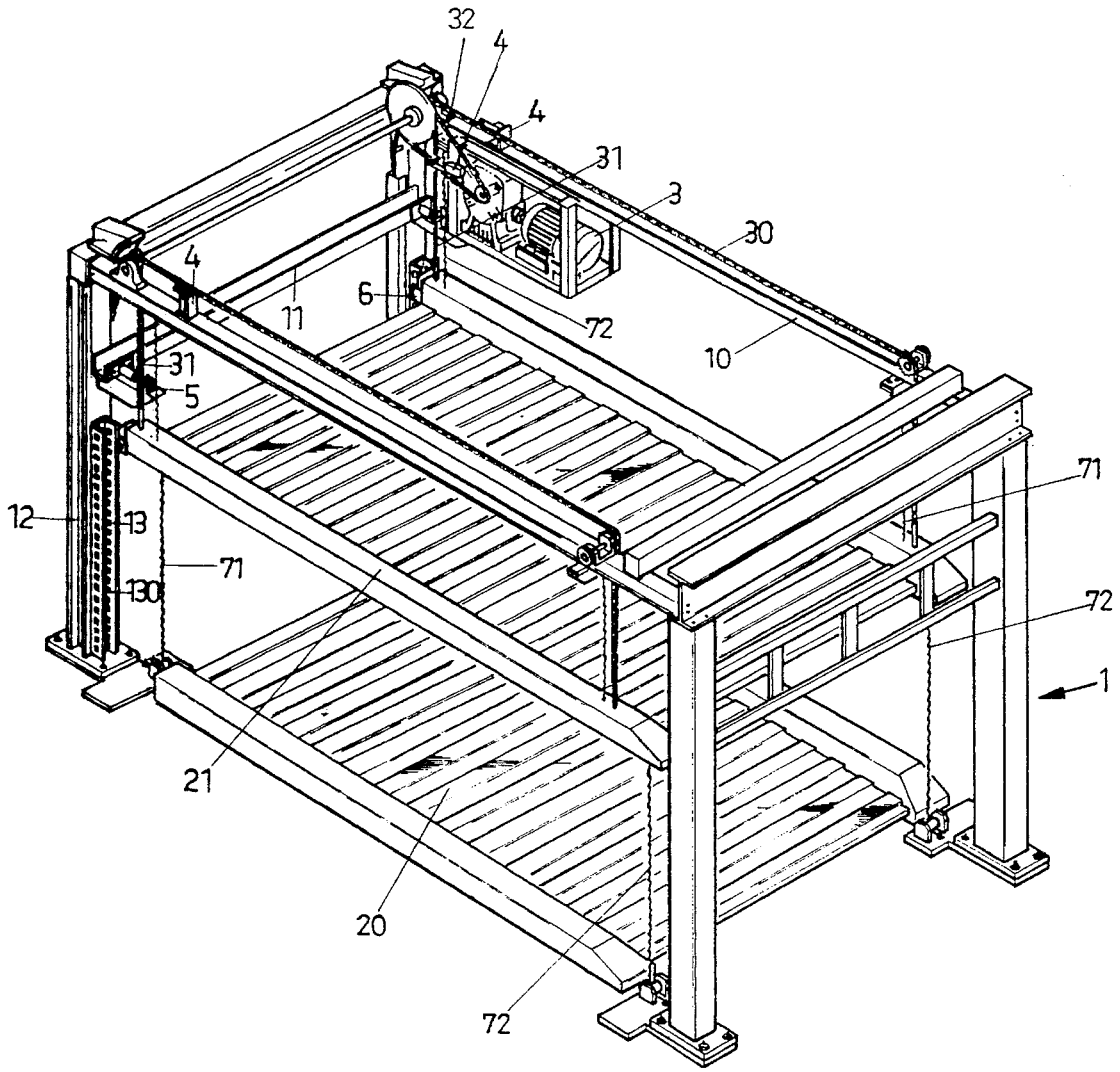
FIG. 1 is a perspective view of the present invention.
Figure 3:
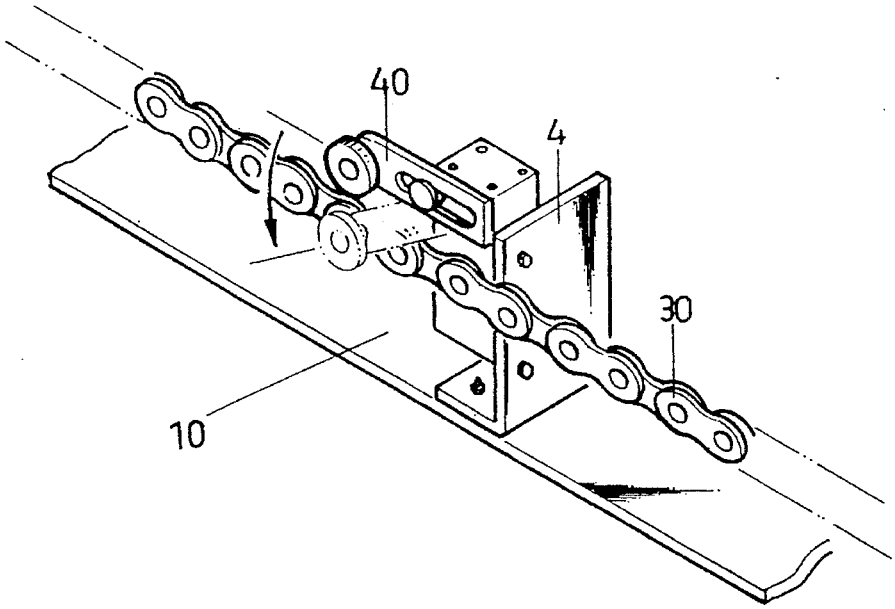
FIG. 3 shows the position of the detector relative to the chain.
Figure 4:
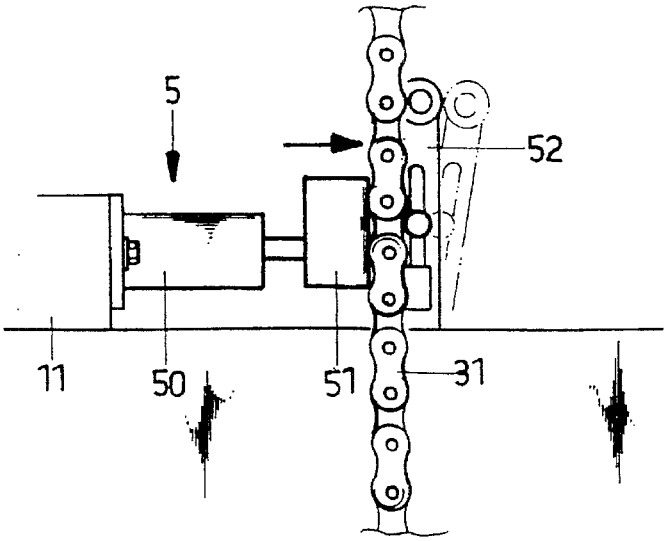
FIG. 4 shows the position of the detecting means relative to the chain.

Please refer to FIG. 1. The parking apparatus of the present invention includes a main body 1 and an upper and a lower parking platforms 21, 20 disposed thereon. A main chain 32 and several subsidiary chains 30, 31 are disposed on lateral sides of the upper parking platform 21 and driven by a drive motor 3 so as to ascend/descend the upper parking platform 21 along the main body 1. The structure of the parking apparatus is not the subject of the present invention and will not be further described herein. Please refer to FIG. 2. The main body 1 has a transverse beam 10 and a lateral beam 11 on which a detector 4 and a detecting means 5 are respectively disposed beside the main chain 32 and subsidiary chains 30, 31. Referring to FIG. 3, the chain 30 is equivalent to the main chain 32. The detector 4 is disposed beside the chain 30 and the main chain 32, having a resilient pressing rod 40. A roller is disposed at a front end of the resilient pressing rod 40 to press against the chain 30 and the main chain 32. The detector 4 further has an inner microswitch (not shown) connected with the resilient pressing rod 40, whereby the resilient pressing rod 40 is able to press down the chain 30 and actuate the microswitch. Referring to FIG. 4, the detecting means 5 is fixedly disposed beside the lateral beam 11 perpendicular to the chain 31, having a resilient pressing post 50. An abutting block 51 is connected with a front end of the resilient pressing post 50 for abutting against one side of the chain 31. A driving lever 52 having an inner microswitch (not shown) is disposed on the other side of the chain 31 opposite to the abutting block 51.

Figure 5:
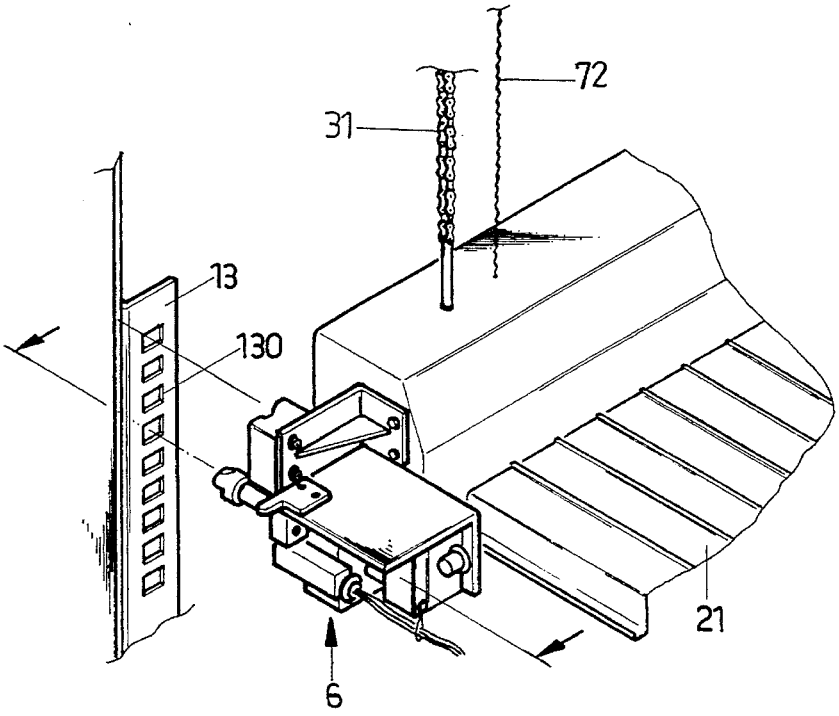
FIG. 5 shows the installation position of the fallproof means.
Figure 6:
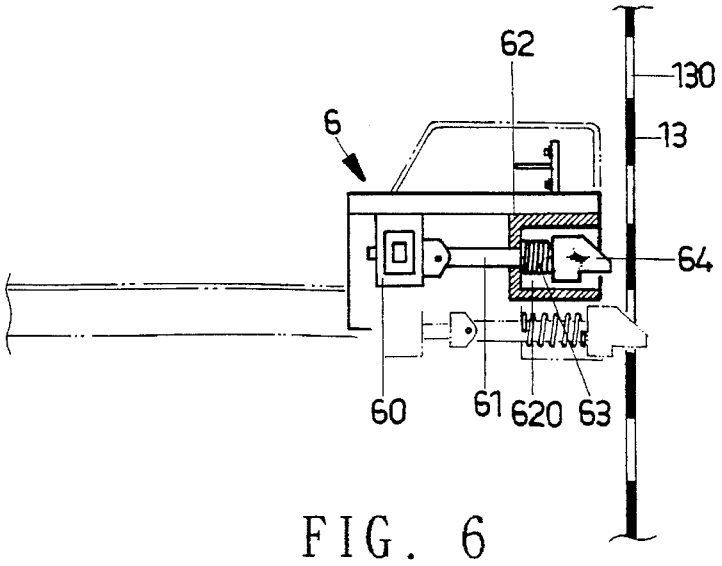
FIG. 6 shows the operation of the fallproof means.

Please refer to FIGS. 5 and 6. Two fallproof means 6 are disposed respectively on two sides of a rear end of the upper parking platform 21. The fallproof means 6 has a microswitch sensitively connected with the microswitches of the detector 4 and the detecting means 5. The fallproof means 6 has an inner solenoid 60 having a front post 61. The front post 60 extends into a chamber 620 of a fixing block 62 to fit with a spring 63. A brake block 64 is disposed at a front end of the front post 61, whereby when the fallproof means 6 is powered on, the solenoid 60 attracts the brake block 64, making the same compress the spring 63 and retract into the chamber 620 of the fixing block 62. On two supports 12 of the main body 1 are disposed fallproof supports 13 having insertion holes 130 corresponding to and for the brake blocks 64 of the fallproof means 6 to insert thereinto.

Figure 2:
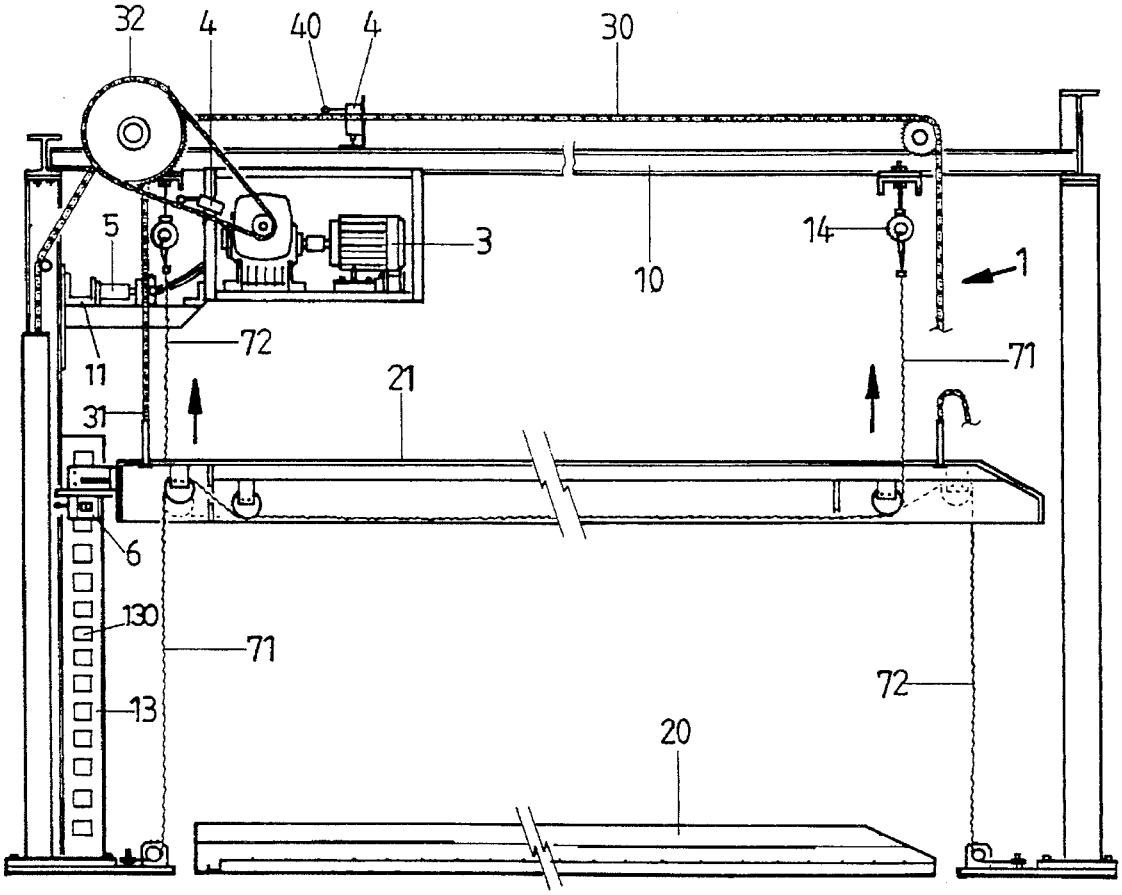
FIG. 2 is a side view according to FIG. 1.

Please refer to FIG. 2. On two sides of a bottom of the upper parking platform 21 are respectively disposed two pairs of steel cables 71, 72. Referring to FIG. 7-1, one end of the steel cable 71 is fixed on a base located on a rear right lower side of the main body 1, while the other end of the steel cable 71 is fixed with a suspending ring 14 located on a front right upper side of the main body 1. Please refer to FIG. 7-2. One end of the other steel cable 72 is fixed with a suspending ring located on a rear right upper side of the main body 1, while the other end of the steel cable 72 is fixed on a base located on a front right lower side of the main body 1. The other pair of steel cables 71, 72 are disposed on a left bottom side of the parking platform 21 corresponding to the right side steel cables 71, 72 in a balance state so as to provide a stabilizing, reinforcing and fallproof effect for the upper parking platform 21. Therefore, the upper parking platform 21 is prevented from swinging during ascending/descending operation. In addition, in case any of the chains is broken 10 apart, the fallproof means 6 will engage with and hold the upper parking platform 21. Also, the steel cables 71, 72 will help in holding the upper parking platform 21.

Please refer back to FIGS. 1 and 2. When a car is parked on the upper parking platform 21 and any section of the chains 32, 30, 31 driven by the motor 3 is broken apart, the resilient pressing rod 40 of the detector 4 or the resilient pressing post 50 of the detecting means 5 will immediately bound out from the broken section of the chains to actuate the microswitch of the detector 4 or the detecting means 5, making the fallproof means 6 powered off. At this time, the attraction of the solenoid suddenly disappears and the post 61 is immediately bounded outside by the spring 63, making the brake block 64 inserted into the insertion hole 130 of the fixing lever 13 of the support 12 and locked therein. Therefore, the upper parking platform 21 with the car is suspended in the air without straightly falling down to cause injury of people and damage of the car.

Figure 8:
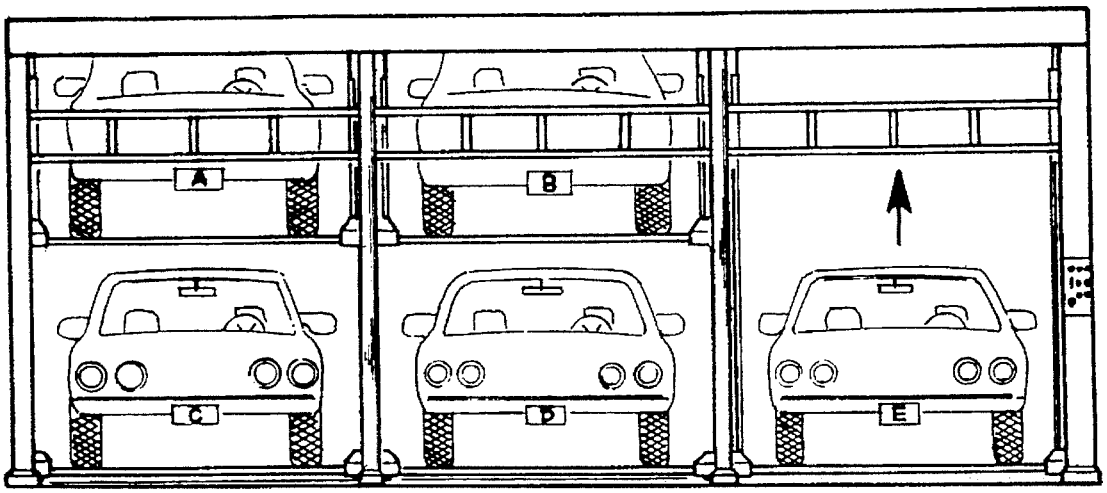
FIG. 8 shows the application of the present invention to a transversely movable parking apparatus.

The present invention can be also applied to transversely movable parking apparatuses which are parallelly arranged as shown in FIG. 8.

In conclusion, the detector and detecting means of the present invention are able to detect the sudden breaking of the chains and transmit a message to the fallproof means to cut off the power therefor, making the fallproof means locked on the supports of the parking platform to stop the same from falling down. In addition, the double steel cables cooperate with the fallproof means in preventing the upper parking platform from falling down to hurt people or the car. Therefore, the parking apparatus can be more safely used.

It should be noted that the above embodiment is only used for illustration and not intended to limit the scope of the present invention. Many modifications of the embodiment can be made without departing from the spirit of the present invention.

What is claimed is:

1. The fallproof safety parking apparatus comprising a main body, an upper and a lower parking platforms disposed thereon, and several chains driven by a motor for ascending/descending said upper parking platform along said main body, said parking apparatus being characterized in that:

said main body has a transverse beam and a lateral beam on which a detector and a detecting means are respectively disposed beside said chains, said detector having a microswitch and a resilient pressing rod pressing against said chains, said detecting means having a resilient pressing post having a front abutting block for abutting against one side of the chains, a driving lever having an inner microswitch being disposed on the other side of the chains opposite to said abutting block;

two fallproof means are disposed respectively on two sides of a rear end of said upper parking platform, each of said fallproof means having a microswitch sensitively connected with said microswitches of said detector and said detecting means, said fallproof means having an inner solenoid having a front post extending into a chamber of a fixing block to fit with a spring, a brake block being disposed at a front end of said front post, on two supports of said main body being disposed fallproof supports having insertion holes corresponding to and for said brake blocks of said fallproof means to insert thereinto; and on two sides of a bottom of said upper parking platform are respectively disposed two pairs of steel cables, one end of one of one pair of said steel cables being fixed on a base located on a rear right lower side of said main body, while the other end of the steel cable being fixed with a suspending ring located on a front right upper side of said main body, one end of the other steel cable of one pair of said steel cables being fixed with a suspending ring located on a rear right upper side of said main body, while the other end of the steel cable being fixed on a base located on a front right lower side of said main body, the other pair of said steel cables being disposed on a left bottom side of said parking platform corresponding to the right side steel cables in a balance state so as to provide a stabilizing, reinforcing and fallproof effect for said upper parking platform, whereby in case any section of said chains is broken apart, said resilient pressing rod of said detector or said resilient pressing post of said detecting means immediately bounds out from the broken section of said chains to actuate said microswitch of said detector or said detecting means, making said fallproof means powered off and at this time, the attraction of said solenoid suddenly disappears, making said brake block inserted into said insertion hole of said fixing lever of said support and locked therein so as to prevent said upper parking platform from straightly falling down.

* * * * *